US008684661B2

(12) United States Patent
Horng et al.

(10) Patent No.: US 8,684,661 B2
(45) Date of Patent: Apr. 1, 2014

(54) FAN MODULE

(75) Inventors: Alex Horng, Kaohsiung (TW); Wen-Kuan Chen, Kaohsiung (TW)

(73) Assignee: Sunonwealth Electric Machine Industry Co., Ltd, Kaohsiung (TW)

( * ) Notice: Subject to any disclaimer, the term of this patent is extended or adjusted under 35 U.S.C. 154(b) by 474 days.

(21) Appl. No.: 13/028,264

(22) Filed: Feb. 16, 2011

(65) Prior Publication Data

US 2012/0156024 A1 Jun. 21, 2012

(30) Foreign Application Priority Data

Dec. 20, 2010 (TW) ..... 99144754 A

(51) Int. Cl.
*F04D 29/44* (2006.01)

(52) U.S. Cl.
USPC ..... 415/53.1; 415/98; 415/99; 415/102; 415/143

(58) Field of Classification Search
USPC ..... 415/93, 97, 98, 99, 101, 102, 143, 203, 415/206
See application file for complete search history.

(56) References Cited

U.S. PATENT DOCUMENTS

| | | | | |
|---|---|---|---|---|
| 3,223,313 | A | 12/1965 | Kinsworthy | |
| 6,637,501 | B2 | 10/2003 | Lin et al. | |
| 6,710,486 | B1 * | 3/2004 | Horng et al. | 310/89 |
| 6,725,906 | B2 * | 4/2004 | Lin et al. | 361/695 |
| 6,877,954 | B2 * | 4/2005 | Lin et al. | 416/175 |
| 7,134,839 | B2 | 11/2006 | Horng et al. | |
| 2006/0024160 | A1 * | 2/2006 | Horng et al. | 415/206 |
| 2008/0117594 | A1 * | 5/2008 | Hwang et al. | 361/697 |

FOREIGN PATENT DOCUMENTS

| | | |
|---|---|---|
| CN | 1727689 A | 2/2006 |
| JP | S58469891 | 3/1983 |
| JP | S5937299 | 2/1984 |
| JP | 2005-214107 | 8/2005 |
| TW | 505376 | 10/2002 |
| TW | 515939 | 1/2003 |

OTHER PUBLICATIONS

Machine translation of JP 2005214107 (A) Kimura Toru; Hashimoto Toshio; Kaneko Sachiko. Aug. 11, 2005.*

* cited by examiner

*Primary Examiner* — Edward Look
*Assistant Examiner* — Maxime Adjagbe
(74) *Attorney, Agent, or Firm* — Alan Kamrath; Kamrath IP Lawfirm, P.A.

(57) ABSTRACT

A fan module includes a housing and an impeller. The housing has an axial air inlet, a radial air inlet and at least one radial air outlet. The impeller is rotatably disposed in the housing and has a first air-guiding blade, a second air-guiding blade and a partitioning member. The partitioning member separates an interior space of the housing into a first air channel and a second air channel. The first air-guiding blade is located in the first air channel, and the second air-guiding blade is located in the second air channel.

19 Claims, 12 Drawing Sheets

FAN MODULE

BACKGROUND OF THE INVENTION

1. Field of the Invention

The present invention relates to a fan module and, more particularly, to a fan module that can draw in air currents from different directions and separate the drawn air currents.

2. Description of the Related Art

Conventional cooling fans generally include an axial-flow type and a blower type. Axial-flow type cooling fans include an axial air inlet and an axial air outlet spaced from the axial air inlet in an axial direction. Air can be drawn in via the axial air inlet and exit via the axial air outlet to provide cooling effect. Blower type cooling fans include an axial air inlet in an axial direction and a radial air outlet in a radial direction. Air can be drawn in via the axial air inlet and exit via the radial air outlet to provide a cooling effect.

Generally, conventional cooling fans of both the axial-flow type and the blower type can be used in various electronic products to prolong the service lives of the electronic products by providing heat dissipation. However, these conventional cooling fans of both the axial-flow type and the blower type can not fulfill the cooling needs in small-size electronic products, such as notebook computers, mobile phones, and personal digital assistants, having a developing trend of miniaturization and having higher operating speeds.

In view of the above disadvantage, Taiwan Utility Model Publication No. 515939 entitled "HEAT DISSIPATING MODULES" discloses a fan module for notebook computers. With reference to FIG. 1, the fan module 8 disclosed includes a fan 81 and a heat dissipater 82. The fan 81 is mounted in a notebook computer 83 for creating air currents. The heat dissipater 82 is mounted in an air outlet of the fan 81 and is engaged with chips 831 of the notebook computer 83. Thus, the fan 81 provides the chips 831 with a predetermined cooling effect.

In use, the fan 81 can only draw external air into the fan module 8 for a cooling effect of a certain portion (such as the chips 831) of the notebook computer 83. The fan 81 can not draw air in other directions into the fan module 8, failing to expel hot air currents generated by the other electronic components of the notebook computer 83 and, thus, providing a limited cooling effect for the notebook computer 83.

FIG. 2 shows Taiwan Invention Publication No. 1264500 entitled "BLOWER TYPE HEAT DISSIPATING FAN WITH INCREASED AIR INPUT". The cooling fan 9 includes a housing 91, a main impeller 92 and an auxiliary impeller 93. The housing 91 includes an air inlet 911 and an air outlet 912. The main impeller 92 is a blower type impeller mounted in the housing 91. The auxiliary impeller 93 is an axial-flow type impeller mounted in the air inlet 911. When the auxiliary impeller 93 rotates, the amount of air inputted via the air inlet 911 can be increased. The main impeller 92 can output the air currents in a sideward direction, increasing the overall cooling effect.

Although the amount of input air of the cooling fan 9 can be increased by the auxiliary impeller 93, the cooling fan 9 can only draw air in the axial direction into the housing 91 and, thus, has the same disadvantage of failing to draw air in other directions when the cooling fan 9 is used in a notebook computer 83 or the like.

Thus, a need exists for a novel fan module that can draw air into the fan in different directions.

SUMMARY OF THE INVENTION

It is therefore the primary objective of this invention to provide a fan module capable of drawing in external air from two different directions. Thus, when the fan module is mounted in various electronic products, the fan module not only can draw the external air into the electronic products for cooling purposes, but also can expel the hot air from the electronic products for an improved cooling effect.

It is therefore another objective of this invention to provide a fan module having an impeller capable of separating air currents coming from two different directions to avoid turbulence.

It is therefore another objective of this invention to provide a fan module having an impeller capable of drawing in external air from different directions and separating air currents, to reduce the axial height of the fan module.

The present invention discloses a fan module including a housing and an impeller. The housing has an axial air inlet, a radial air inlet and at least one radial air outlet. The impeller is rotatably disposed in the housing and has a first air-guiding blade, a second air-guiding blade and a partitioning member. The partitioning member separates an interior space of the housing into a first air channel and a second air channel, the first air-guiding blade is located in the first air channel, and the second air-guiding blade is located in the second air channel.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
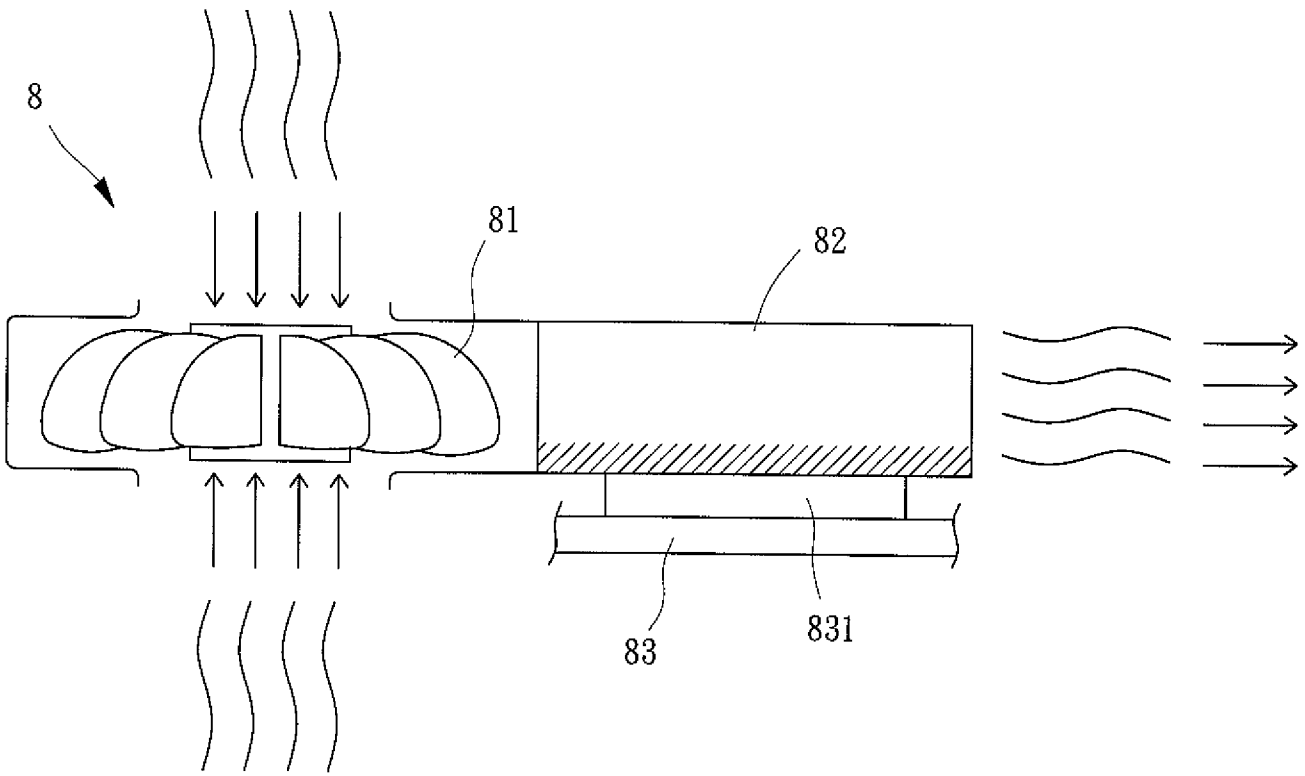
FIG. 1 PRIOR ART
FIG. 1 shows a conventional fan module.
Figure 2:
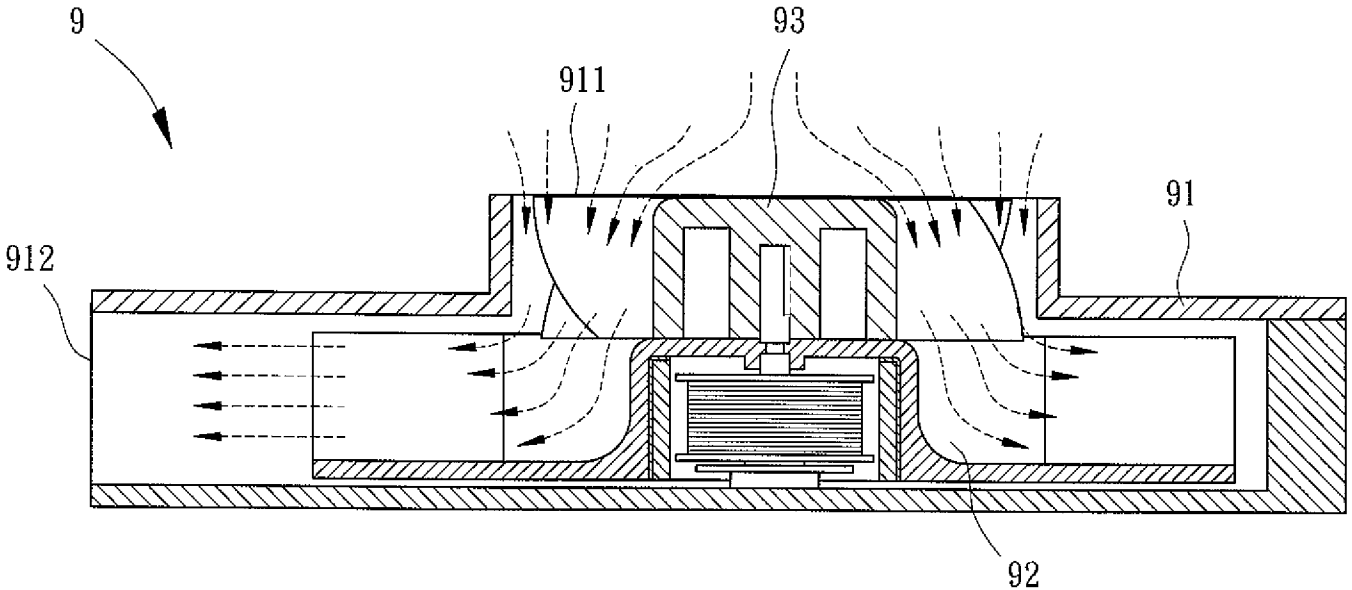
FIG. 2 PRIOR ART
FIG. 2 shows a side cross-sectional view of another conventional fan module.

In the various figures of the drawings, the same numerals designate the same or similar parts. Furthermore, when the terms "first", "second", "third", "fourth", "inner", "outer," "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 3:
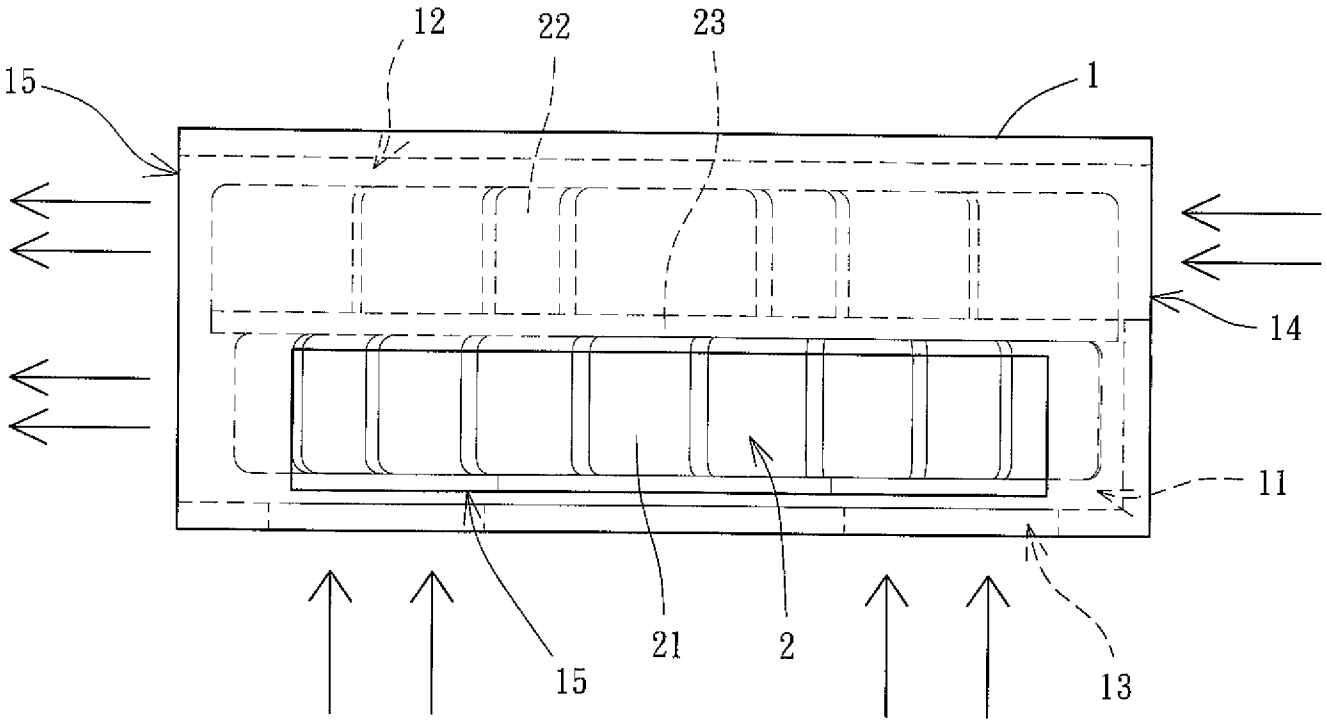
FIG. 3 shows a side cross-sectional view of a fan module according to present invention.

With reference to FIG. 3, a fan module according to the present invention includes a housing 1 and an impeller 2. The housing 1 can be of any form and shape for receiving the impeller 2. The impeller 2 is mounted in the housing 1 for not only drawing in air currents in different directions to provide a predetermined cooling effect, but also for separating the air currents drawn in the two different directions.

Figure 4:
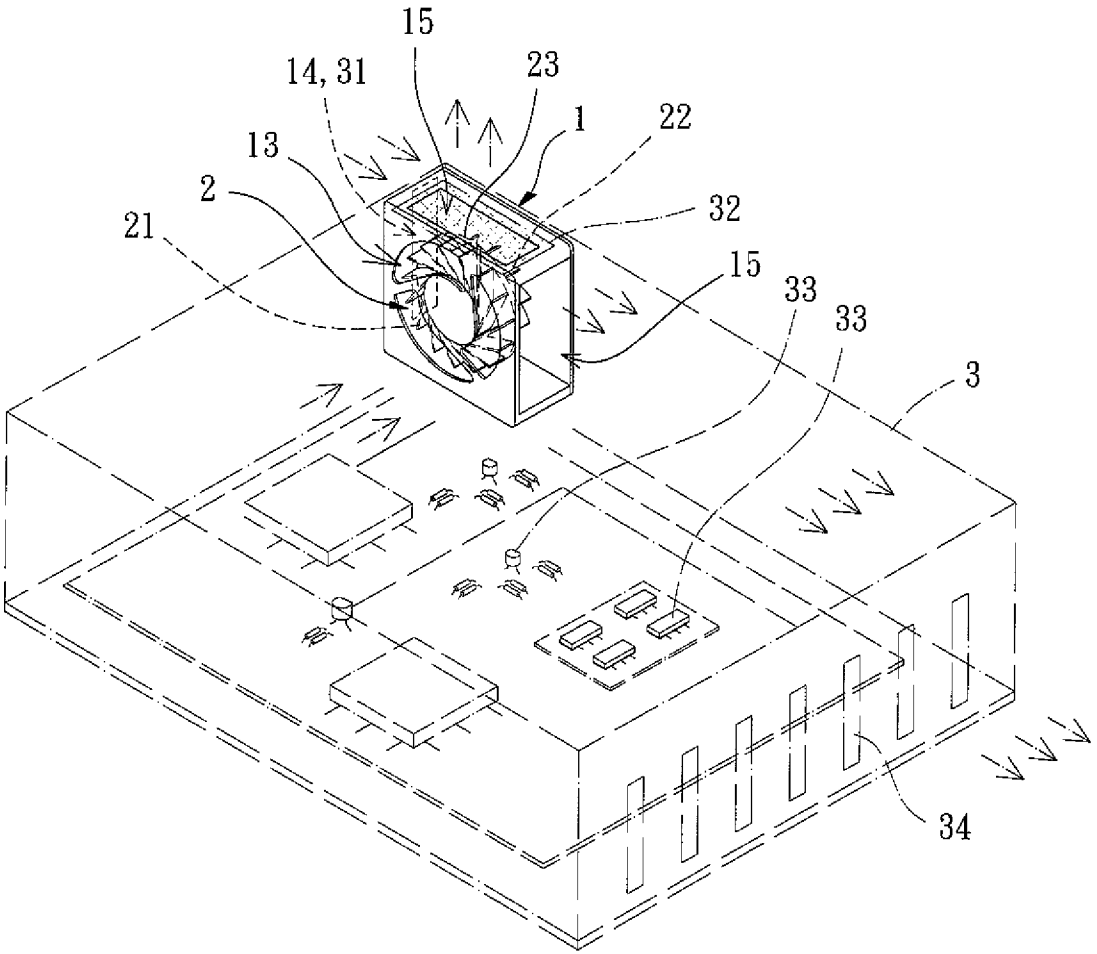
FIG. 4 shows an electronic product equipped with the fan module of present invention.

The housing 1 includes a first air channel 11 and a second air channel 12. The housing 1 further includes an axial air inlet 13, a radial air inlet 14 and at least one radial air outlet 15. FIG. 4 shows an example having two radial air outlets 15. The axial air inlet 13 is in communication with the first air channel 11. The radial air inlet 14 is in communication with the second air channel 12. The at least one radial air outlet 15 is in communication with the first and second air channels 11 and 12.

The impeller 2 can be of any member that can be driven to rotate for guiding air currents. The impeller 2 is mounted in the housing 1 and includes a first air-guiding blade 21, a second air-guiding blade 22 and a partitioning member 23. The first air-guiding blade 21 is located in the first air channel 11 for drawing external air into the first air channel 11 via the axial air inlet 13, and for expelling the air from the first air channel 11 via the at least one radial air outlet 15. The second air-guiding blade 22 is located in the second air channel 12 for drawing external air into the second air channel 12 via the radial air inlet 14, and for expelling the air from the second air channel 12 via the at least one radial air outlet 15. The partitioning member 23 separates the first air channel 11 from the second air channel 12 in the housing 1.

With reference to FIGS. 3 and 4, when in use of the fan module according to the present invention, the fan module can be mounted in an electronic product 3, such as a notebook computer, a mobile phone, or a personal digital assistant, to provide a predetermined cooling effect. In this example, the electronic product 3 includes an air inlet portion 31 and an air outlet portion 32. The fan module according to the present invention is mounted in the electronic product 3 with the radial air inlet 14 of the housing 1 aligned with the air inlet portion 31, with the axial air inlet 13 located in an interior of the electronic product 3, with one of the at least one radial air outlets 15 facing various electronic components 33 of the electronic product 3, and with one of the other radial air outlet 15 aligned with the air outlet portion 32. By such an arrangement, external air can be drawn in by the second air-guiding blade 22 of the impeller 2 via the radial air inlet 14 can be guided by one of the radial air outlets 15 to the electronic components 33, and can then exit via auxiliary air outlets 34, providing a cooling effect.

By the above structural design, the primary feature of the fan module according to the present invention is that the first air-guiding blade 21 of the impeller 2 draws air currents into the first air channel 11 via the axial air inlet 13 and then expels the air currents via the at least one radial air outlet 15, providing heat dissipation. At the same time, the second air-guiding blade 22 of the impeller 2 draws air currents into the second air channel 12 via the radial air inlet 14 and then expels the air currents via the at least one radial air outlet 15. Thus, the fan module according to the present invention can draw in air currents in two different directions (the axial and radial directions) and can be used in various electronic products 3. In addition to drawing in external air, the hot air currents in the electronic product 3 can be expelled to the environment to enhance the cooling efficiency.

More importantly, based on the partitioning member 23 that separates the first air channel 11 from the second air channel 12, the air currents drawn from different directions (axial and radial directions) by the first air-guiding blade 21 and second air-guiding blade 22 can be efficiently separated by the partitioning member 23, allowing the drawn air currents to be expelled from the fan module via the at least one radial air outlet 15. Thus, turbulence is avoided, noise is reduced and air flowing is facilitated. Furthermore, since the impeller 2 is able to draw in external air from different directions and to separate the drawn air currents, no additional components are required for providing the same functions. Thus, the entire structural complexity of the fan module is simplified, and the axial height of the fan module is reduced.

Although the radial air inlet 14 of the housing 1 is shown to be aligned with the air inlet portion 31 and the axial air inlet 13 is shown to be located in the interior of the electronic product 3 in FIG. 4, the axial air inlet 13 and radial air inlet 14 of the housing 1 may also be arranged on other locations of the electronic product 3 to draw external air from different directions for cooling purposes.

Based on the structural designs of the housing 1 and the impeller 2, the fan module of the invention may be implemented in various ways as described below (note the implementations of the housing 1 and the impeller 2 described below are merely for illustration purposes, and other implementations capable of providing the same functions are encompassed by the invention).

Figure 5:
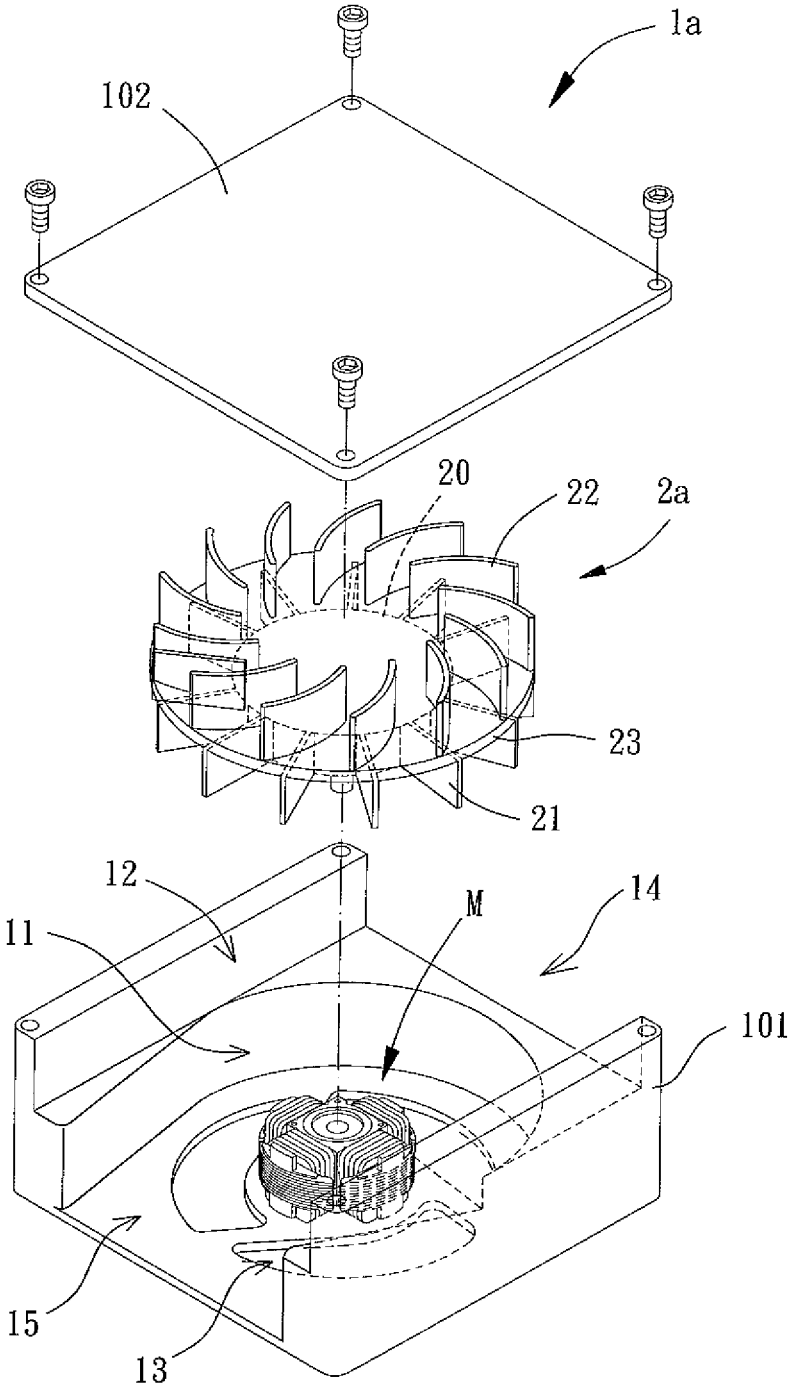
FIG. 5 shows an exploded diagram of a fan module according to a first embodiment of present invention.
Figure 6:
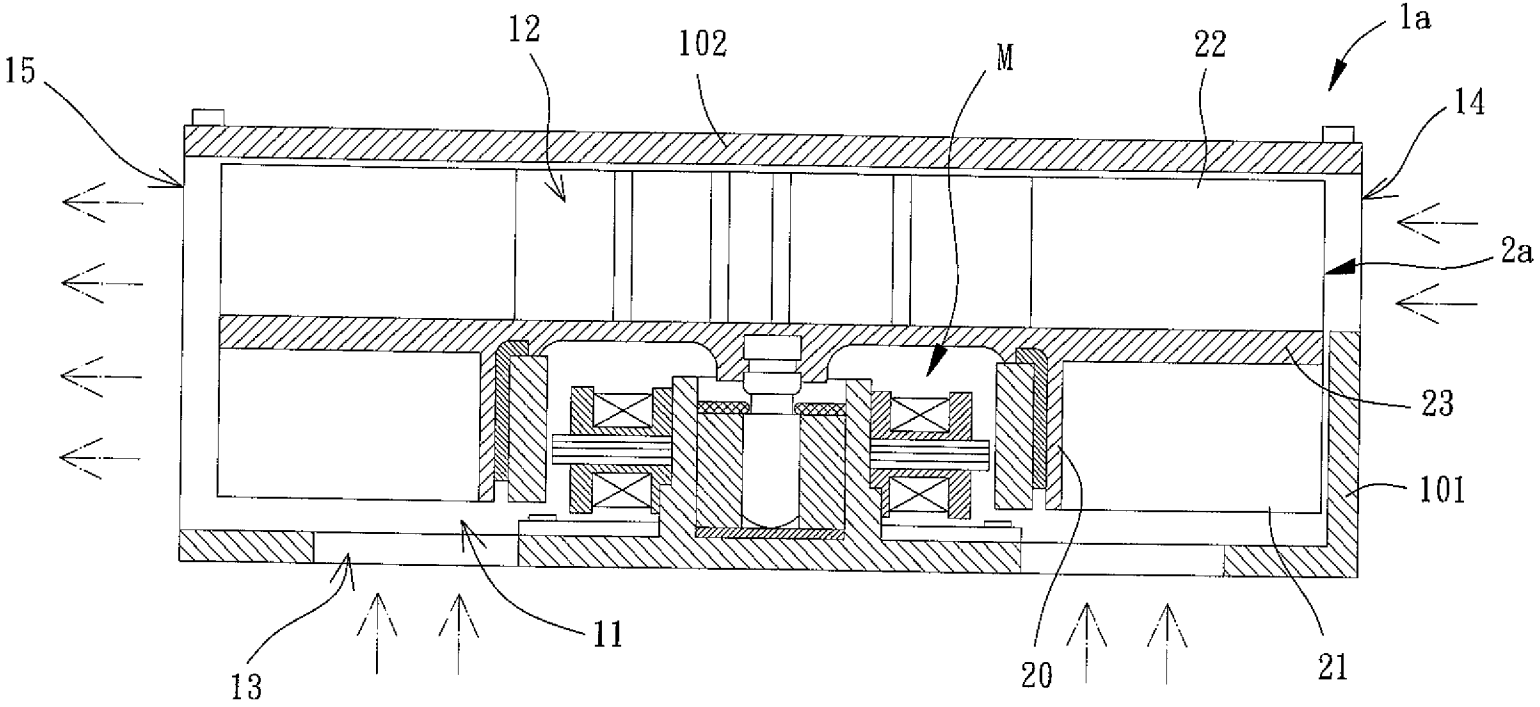
FIG. 6 shows a side cross-sectional view of the fan module according to the first embodiment of present invention.

With reference to FIGS. 5 and 6, a fan module according to a first embodiment of the present invention includes a housing 1*a* having a housing body 101 and a covering plate 102. In FIG. 5, the housing 1*a* includes an axial air inlet 13 on the bottom thereof, as well as a radial air inlet 14 on a side thereof (namely, the radial air inlet 14 is located between the housing body 101 and the covering plate 102). In the embodiment, the housing 1*a* further includes a radial air outlet 15 on another side thereof (namely, the radial air outlet 15 is also located between the housing body 101 and the covering plate 102), with the radial air outlet 15 communicating with both the first air channel 11 and the second air channel 12.

The fan module further includes an impeller 2*a* having a hub 20. With reference to the FIGS. 5 and 6, the partitioning member 23 is in the form of a circular partitioning plate, which may be integrally formed on a top of the hub 20 and may extend outwards radially from a circumferential wall of the hub 20, as shown in FIG. 5. Alternatively, the circular partitioning plate can also be detachably assembled to the top of the hub 20. The first air-guiding blade 21 is arranged on a circumferential wall of the hub 20 and couples with the partitioning member 23. The second air-guiding blade 22 is arranged on a top face of the partitioning member 23 that faces the covering plate 102. In such an arrangement, the partitioning member 23 can separate the first air channel 11 from the second air channel 12 in a way that the first air-guiding blade 21 is located in the first air channel 11 and that the second air-guiding blade 22 is located in the second air channel 12. Based on this, the housing 1*a* can accommodate a motor driving unit M that is coupled to the impeller 2*a* for driving the impeller 2*a*.

When the fan module of the first embodiment is in use, the first air-guiding blade 21 of the impeller 2*a* can draw external air into the fan module via the axial air inlet 13 and guide the air inside the first air channel 11 to a heat source via the radial air outlet 15. Simultaneously, the second air-guiding blade 22 of the impeller 2*a* can draw external air into the fan module via the radial air inlet 14 and guide the air inside the second air channel 12 to the heat source via the radial air outlet 15. Thus, the fan module according to the present invention can draw in air currents in two different directions (the axial and radial directions) and can be used in various electronic products 3. In addition, the partitioning member 23 of the impeller 2*a* can also separate the first air channel 11 from the second air channel 12, thus avoiding turbulence, simplifying the entire structural complexity and reducing the axial height of the fan module.

Figure 7:
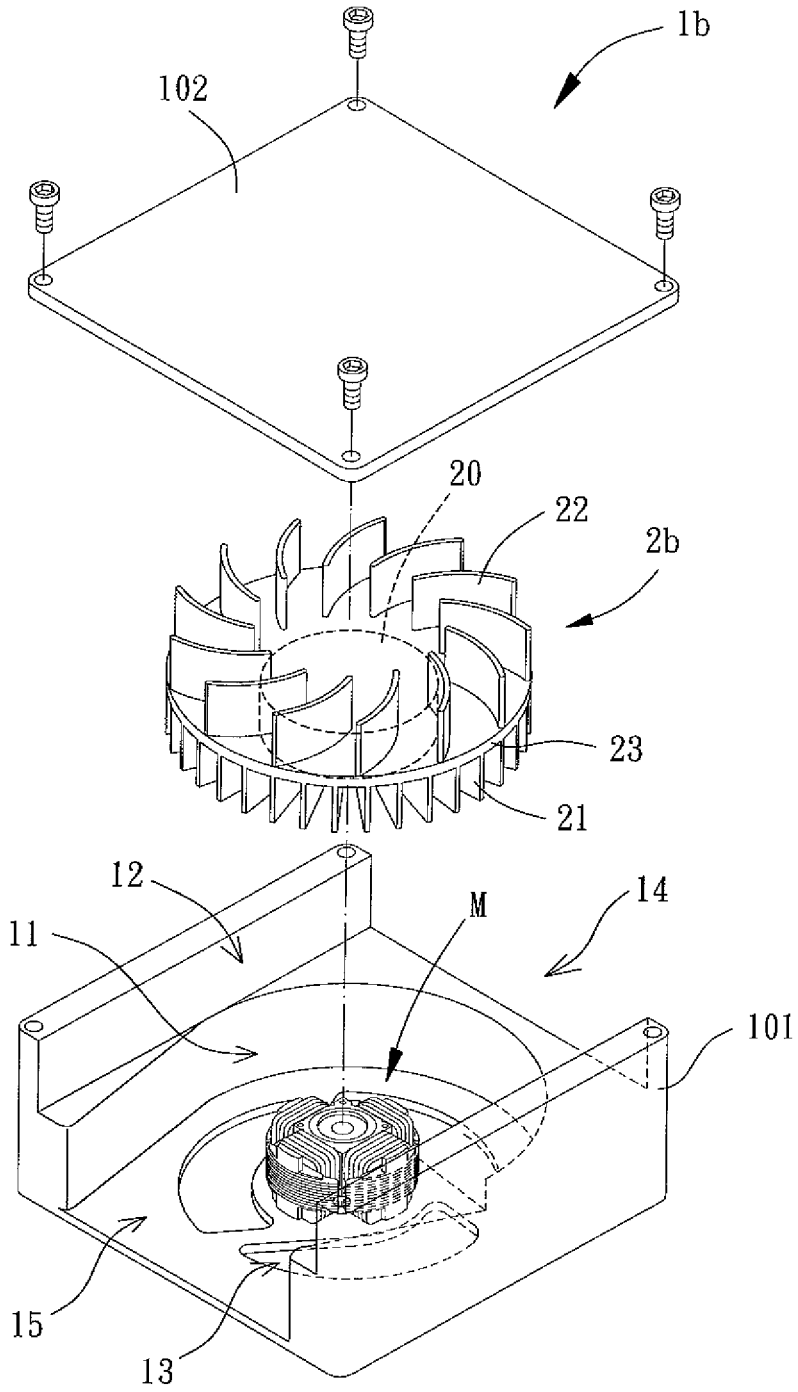
FIG. 7 shows an exploded diagram of a fan module according to a second embodiment of present invention.
Figure 8:
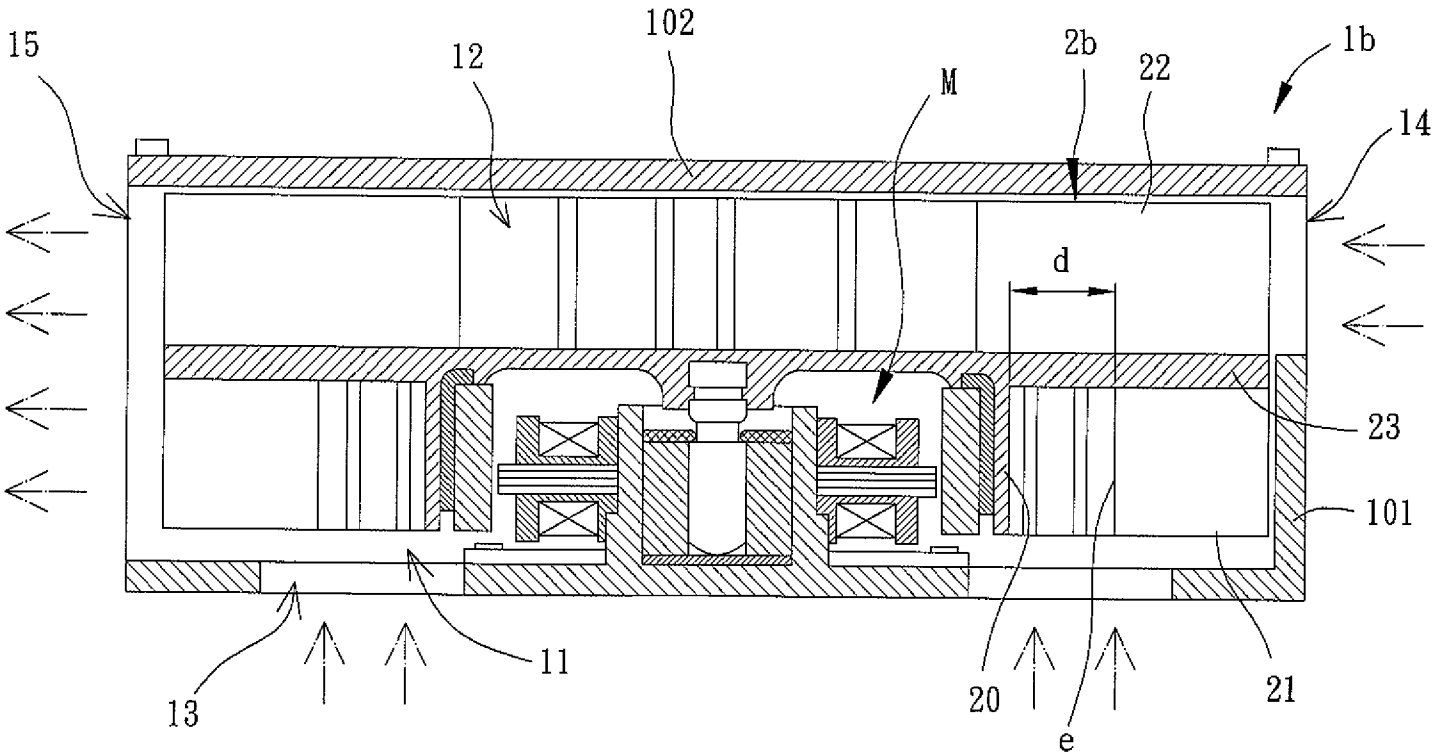
FIG. 8 shows a side cross-sectional view of the fan module according to the second embodiment of present invention.

With reference to FIGS. 7 and 8, a fan module according to a second embodiment of the present invention includes a housing 1*b* and an impeller 2*b*. The fan module in the second embodiment differs from that of the first embodiment in that the first air-guiding blade 21 is arranged under the partitioning member 23 and does not couple with the circumferential wall of the hub 20. Since the end e of the first air-guiding blade 21 that faces the hub 20 is spaced from the circumferential wall of the hub 20 by a distance d, turbulence can be more efficiently avoided when the first air-guiding blade 21 of the impeller 2*b* draws external air into the fan module via the axial air inlet 13. Thus, the cooling effect is improved.

Figure 9:
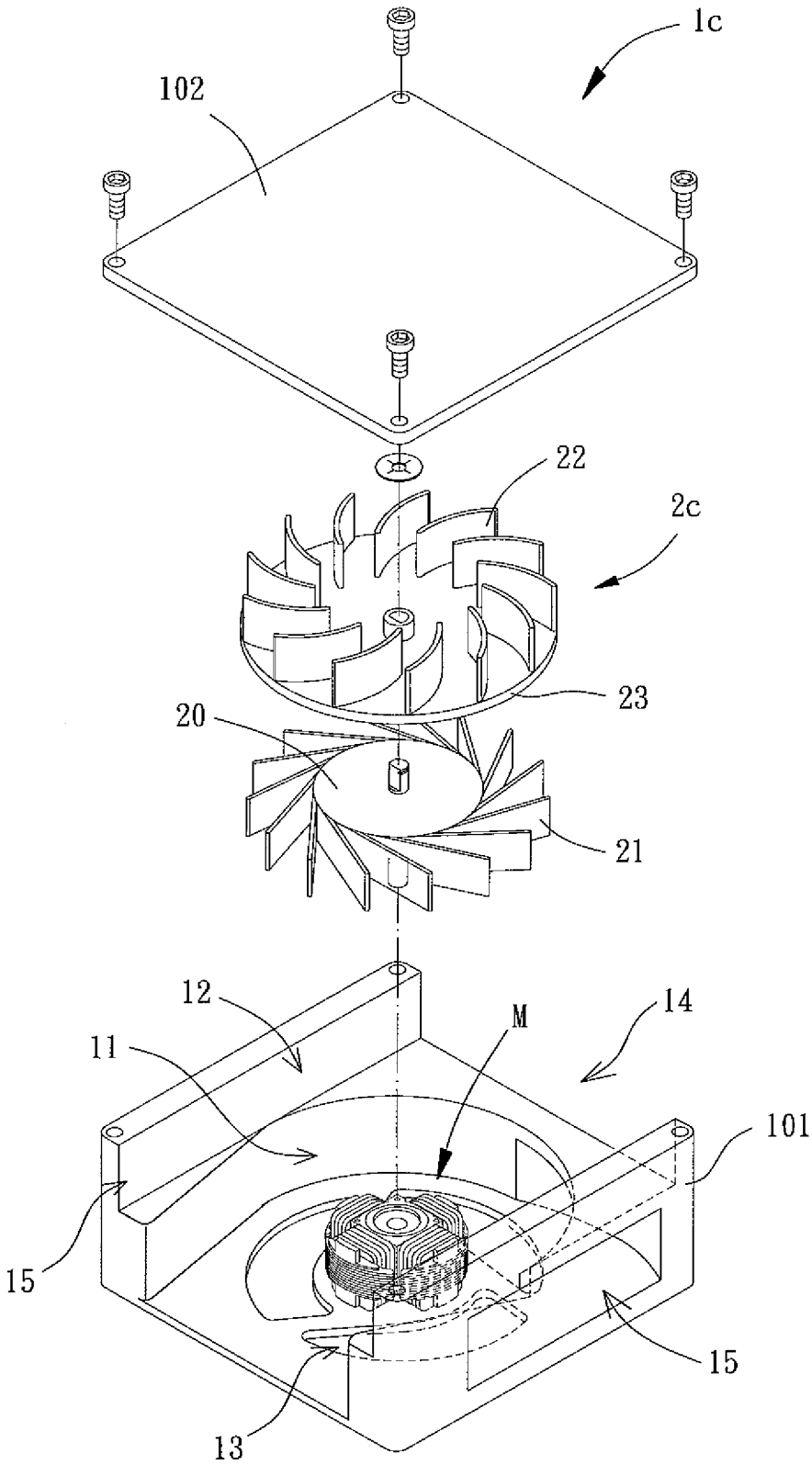
FIG. 9 shows an exploded diagram of a fan module according to a third embodiment of present invention.
Figure 10:
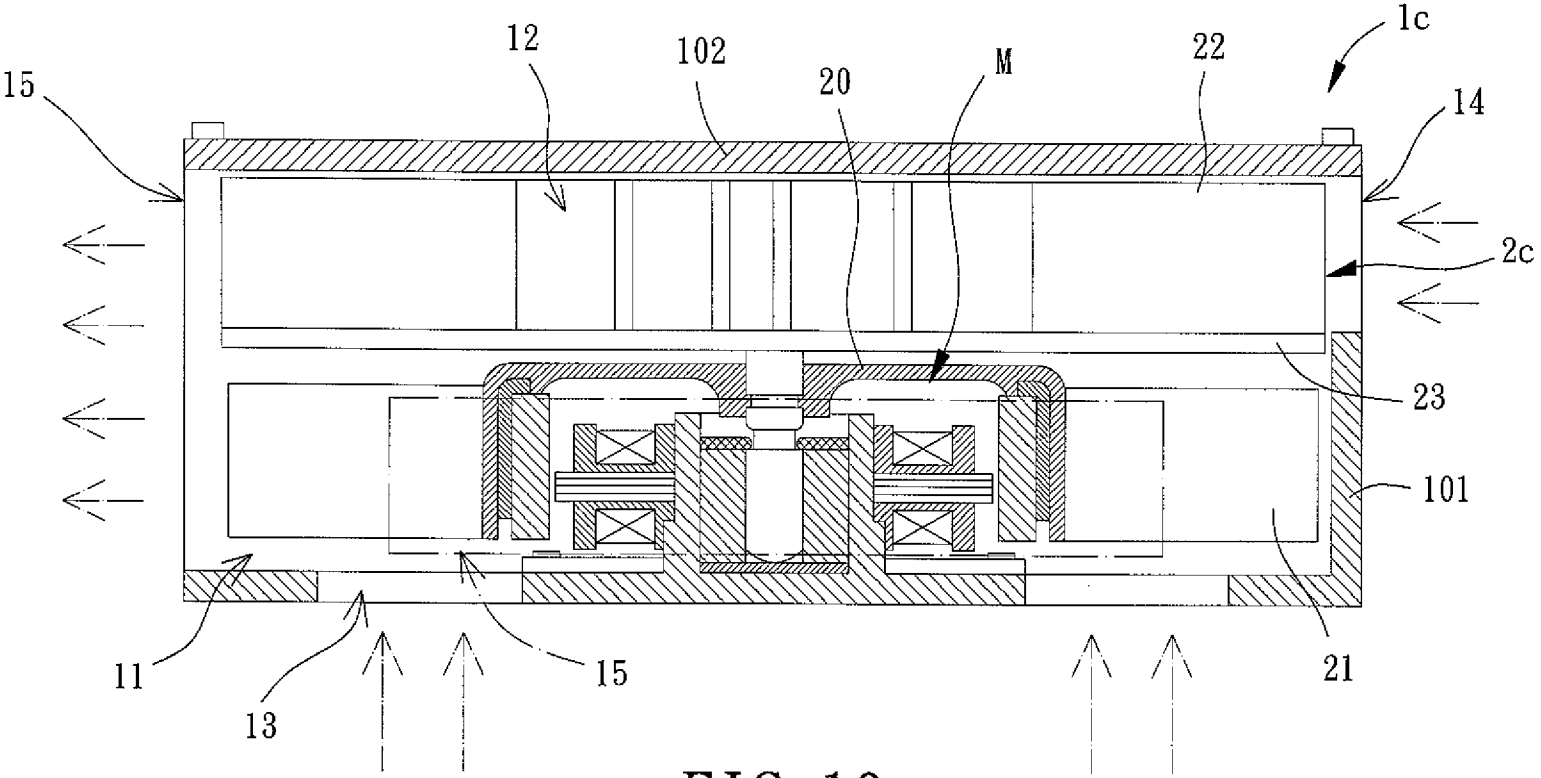
FIG. 10 shows a side cross-sectional view of the fan module according to the third embodiment of present invention.

With reference to FIGS. 9 and 10, a fan module according to a third embodiment of the present invention includes a housing 1*c* and an impeller 2*c*. The fan module in the third embodiment differs from that of the first embodiment in that the housing 1*c* has two radial air outlets 15 on two sides thereof. In particular, an included angle is present between the two radial air outlets 15 in a radiate direction. Furthermore, the partitioning member 23 is in the form of a circular partitioning plate that can be detachably assembled to the hub 20. Overall, the fan module in the third embodiment is advantageous than that in the first embodiment in terms of detachability.

Figure 11:
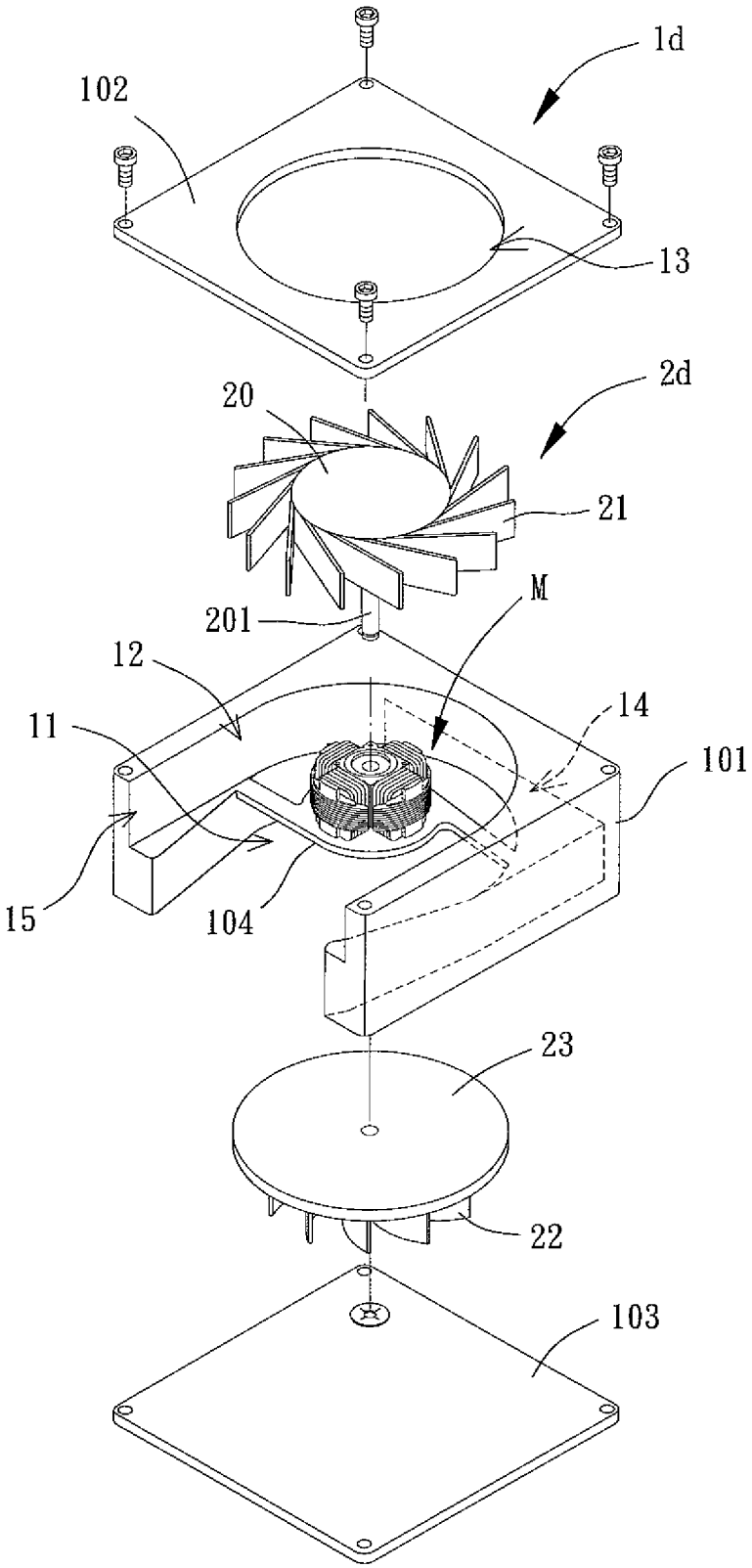
FIG. 11 shows an exploded diagram of a fan module according to a fourth embodiment of present invention.
Figure 12:
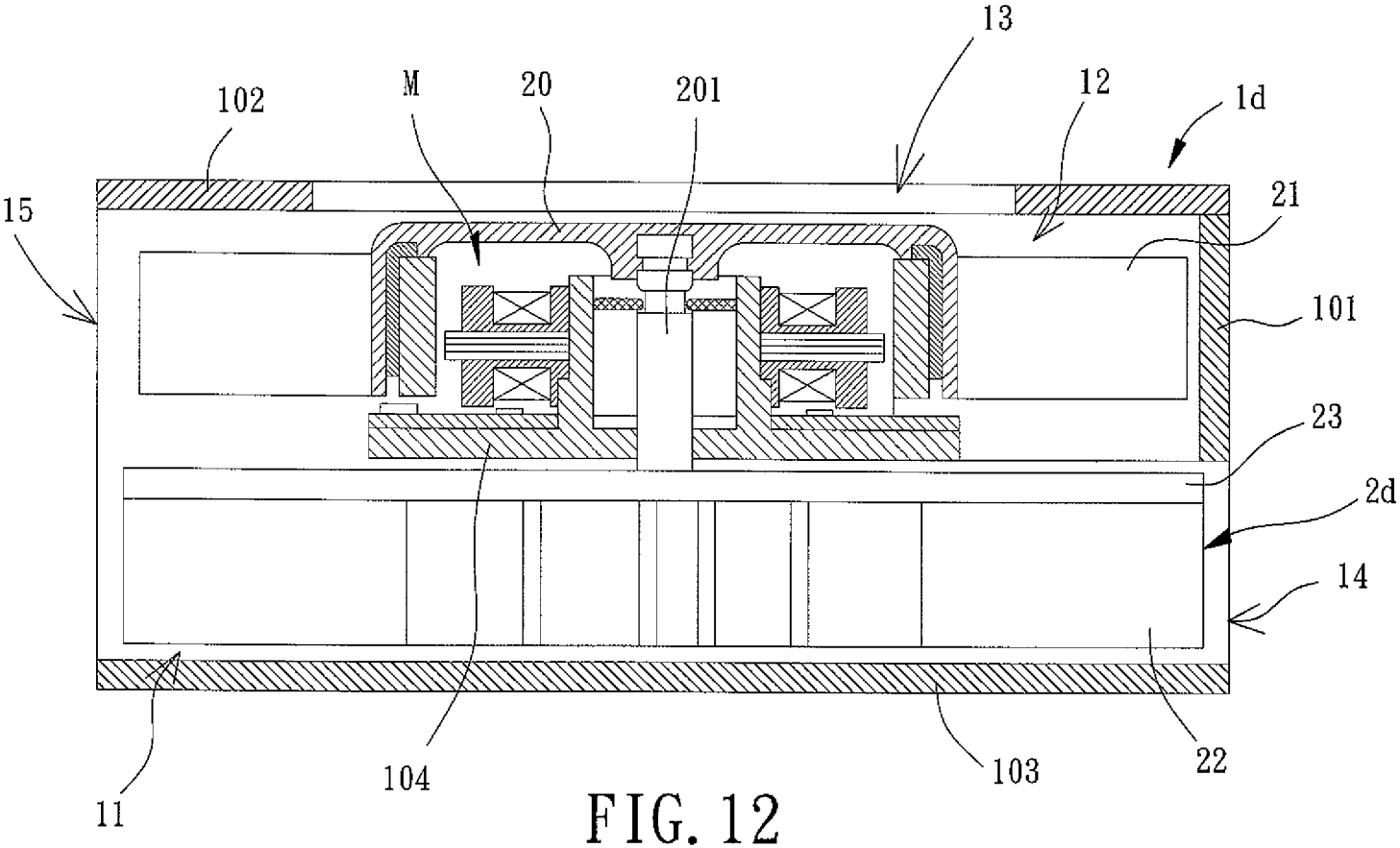
FIG. 12 shows a side cross-sectional view of the fan module according to the fourth embodiment of present invention.

With reference to FIGS. 11 and 12, a fan module according to a fourth embodiment of the present invention includes a housing 1*d* and an impeller 2*d*. The fan module in the fourth embodiment differs from that of the first embodiment in that the first air channel 11 and the second air channel 12 are located in different locations, and the housing 1*d* consists of a housing body 101, a covering plate 102 and a bottom plate 103. The housing body 101 includes a base 104 disposed therein for supporting a motor driving unit M that is located in the second air channel 12. Based on FIG. 11, the axial air inlet 13 is shown to be arranged on a top of the housing 1*d* (namely, located on the covering plate 102), and the radial air inlet 14 and the radial air outlet 15 are shown to be arranged on two sides of the housing body 101. Moreover, the hub 20 of the impeller 2*d* has a shaft 201 coupled with the motor driving unit M and extending into the second air channel 12. In the embodiment, the partitioning member 23 is in the form of a circular partitioning plate for coupling with the shaft 201, allowing the motor driving unit M to simultaneously drive the partitioning member 23 to rotate while driving the hub 20 to rotate through the shaft 201. Thus, the embodiment provides the fan module with a different structure from those of other embodiments described above while providing the same functions.

As described above, the fan module of the present invention uses the first air-guiding blade 21 and the second air-guiding blade 22 to draw in external air from different directions via the axial air inlet 13 and the radial air inlet 14, respectively, and then guide the air inside the fan module to a predetermined location via the at least one radial air outlet 15 for cooling purposes. Thus, when the fan module is mounted in the electronic product 3, the fan module not only can efficiently draw external air into the electronic product 3, but also can expel the hot air from the electronic product 3 for an improved cooling effect.

Furthermore, since the partitioning member 23 can separate the first air channel 11 from the second air channel 12 to prevent the air currents coming from different directions from mixing together, turbulence is avoided, noise is reduced, and air flowing is facilitated. Also, the entire structural complexity of the fan module is simplified, and the axial height of the fan module is reduced.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A fan module comprising:

a housing having an axial air inlet, a radial air inlet and at least one radial air outlet; and an impeller rotatably disposed in the housing and having a first air-guiding blade, a second air-guiding blade and a partitioning member, wherein the partitioning member separates an interior space of the housing into a first air channel and a second air channel, wherein the first air-guiding blade is located in the first air channel and the second air-guiding blade is located in the second air channel, wherein the axial air inlet communicates with the first air channel, and wherein the radial air inlet communicates with the second air channel wherein the housing further comprises a housing body and a covering plate secured together, wherein the housing body comprises a bottom wall and a lateral wall integrally extending from the bottom wall towards but spaced from the covering plate, wherein the partitioning member comprises a first face and a second face opposite to the first face, wherein the first face faces the bottom wall of the housing body, wherein the second face faces the covering plate, wherein the first air channel is formed between the first face of the partitioning member and the bottom wall of the housing body, wherein the second air channel is formed between the second face of the partitioning member and the covering plate, wherein the axial air inlet extends through the bottom wall of the housing body and is in communication with the first air channel, wherein the radial air inlet is in communication with the second air channel, wherein the first air-guiding blade is located in the first air channel, wherein the second air-guiding blade is located in the second air channel and arranged on the second face of the partitioning member, and wherein the axial air inlet and the radial air inlet are located at different sides of the partitioning member.

2. The fan module as claimed in claim 1, wherein the at least one radial air outlet communicates with the first and second air channels.

3. The fan module as claimed in claim 1, wherein the covering plate is free of a through-hole.

4. The fan module as claimed in claim 3, wherein the at least one radial air outlet is a single radial air outlet.

5. The fan module as claimed in claim 3, wherein the at least one radial air outlet comprises two radial air outlets communicating with the first air channel and the second air channel, respectively.

6. The fan module as claimed in claim 5, wherein the two radial air outlets are located on two sides of the housing spaced from each other.

7. The fan module as claimed in claim 5, wherein the impeller has a hub, the partitioning member is in the form of a circular partitioning plate, and the circular partitioning plate is integrally formed on a top of the hub or is detachably assembled to the hub.

8. The fan module as claimed in claim 7, wherein the first air-guiding blade is arranged on a circumferential wall of the hub and couples with the partitioning member, and wherein the second air-guiding blade is arranged on a top face of the partitioning member.

9. The fan module as claimed in claim 7, wherein the first air-guiding blade is arranged under the partitioning member and the second air-guiding blade is arranged on a top face of the partitioning member.

10. The fan module as claimed in claim 9, wherein the first air-guiding blade has an end facing the hub and spaced from the circumferential wall of the hub by a distance.

11. The fan module as claimed in claim 3, wherein the housing receives a motor driving unit coupled with the impeller.

12. The fan module as claimed in claim 1, wherein the housing includes a base disposed therein for supporting a motor driving unit located in the second air channel, the impeller includes a hub having a shaft, and the shaft is coupled with the motor driving unit and extends into the first air channel to couple with the partitioning member.

13. The fan module as claimed in claim 3, wherein the at least one radial air outlet communicates with the first and second air channels.

14. A fan module comprising: a housing having an axial air inlet, a radial air inlet and at least one radial air outlet; and an impeller rotatably disposed in the housing and having a first air-guiding blade, a second air-guiding blade and a partitioning member, wherein the partitioning member separates an interior space of the housing into a first air channel and a second air channel, and wherein the first air-guiding blade is located in the first air channel and the second air-guiding blade is located in the second air channel, wherein the axial air inlet communicates with the first air channel, and wherein the radial air inlet communicates with the second air channel, wherein the housing further comprises a housing body, a covering plate and a bottom plate, with the housing body secured to and located intermediate the covering and bottom plates, wherein the partitioning member comprises a first face and a second face opposite covering plate, wherein the second air channel is formed between the first face of the partitioning member and the bottom plate, wherein the first air channel is formed between the second face of the partitioning member and the covering plate, wherein the axial air inlet extends through the covering plate of the housing body and is in communication with the first air channel, wherein the first air-guiding blade is located in the first air channel, wherein the second air-guiding blade is located in the second air channel and arranged on the first face of the partitioning member, and wherein the axial air inlet and the radial air inlet are located at different sides of the partitioning member.

15. The fan module as claimed in claim 14, wherein the at least one radial air outlet communicates with the first and second air channels.

16. The fan module as claimed in claim 14, wherein the housing receives a motor driving unit coupled with the impeller.

17. The fan module as claimed in claim 14, wherein the housing includes a base disposed therein for supporting a motor driving unit located in the first air channel, the impeller includes a hub having a shaft, and the shaft is coupled with the motor driving unit and extends into the first air channel to couple with the partitioning member.

18. The fan module as claimed in claim 14, wherein the at least one radial air outlet is a single radial air outlet.

19. The fan module as claimed in claim 14, wherein the bottom plate is free of a through hole.

* * * * *